United States Patent [19]

Kelly et al.

[11] Patent Number: 4,612,042

[45] Date of Patent: Sep. 16, 1986

[54] METHOD FOR AUTOMATICALLY FLUXING AND CASTING SAMPLES

[75] Inventors: John H. Kelly, Burlington; Leonard E. Guest, Binbrook, both of Canada

[73] Assignee: Stelco Inc., Hamilton, Canada

[21] Appl. No.: 754,991

[22] Filed: Jul. 15, 1985

Related U.S. Application Data

[62] Division of Ser. No. 601,687, Apr. 18, 1984, Pat. No. 4,563,146.

[51] Int. Cl.[4] ..... C22B 7/04

[52] U.S. Cl. ..... 75/24; 73/863.11; 75/97 R; 366/144; 422/63; 436/175

[58] Field of Search ..... 75/24, 61, 97 R, 101 R; 266/240; 436/174, 175; 422/63, 64, 65; 73/863.11, 864.53; 366/209, 219, 239, 144

[56] References Cited

U.S. PATENT DOCUMENTS

| | | | |
|---|---|---|---|
| 3,259,485 | 7/1966 | Kootz et al. | 75/61 |
| 4,138,209 | 2/1979 | Bahr | 266/240 |
| 4,401,625 | 8/1983 | Willay et al. | 436/174 |

*Primary Examiner*—Melvyn J. Andrews
*Attorney, Agent, or Firm*—Sim & McBurney

[57] ABSTRACT

A method of fluxing an oxide sample includes placing the sample in a crucible which has a central axis and a bottom, and heating the crucible and thus the oxide sample. A motion is applied to the crucible whereby the central axis moves to describe a conical surface with an apex on the central axis and spaced from the bottom of the crucible by a distance equal to or less than the crucible height. The crucible itself is restrained against rotation about its own axis.

5 Claims, 5 Drawing Figures

METHOD FOR AUTOMATICALLY FLUXING AND CASTING SAMPLES

This is a divisional of U.S. patent application Ser. No. 601,687, filed on Apr. 18, 1984, now U.S. Pat. No. 4,563,146.

This invention relates to an apparatus for fluxing oxide samples prior to analysis, and a manipulation procedure for such fluxing.

BACKGROUND OF THIS INVENTION

Oxide materials like blast furnace slag, steelmaking slag, iron ore, etc. are typically prepared for analysis using a procedure involving fusion in low melting point flux. In the case of analysis by x-ray fluorescence, the melt can be poured into a casting dish and the resulting bead needs no further preparation. In the case of solution methods of analysis, such as AAS (atomic absorption spectrometry), DCP (direct current plasma optical emission spectrometry), and ICP (inductively coupled plasma optical emission spectrometry), the melt may be slowly poured into a beaker of dilute aqueous acid and dissolution will be very rapid.

The substitution of automatic devices for manual methods of manipulating the melt's container during fusion is desirable for many objectives, including lower direct labour cost, longer life of the melt container or containers, shorter preparation time per sample, multiple samples prepared in time parallel fashion, uniform quality of performance, improved accuracy and repeatability.

There has been some evolutionary development of automatic fusion devices, but these prior art techniques suffer from one or more of the following disadvantages:

(1) high initial cost (2) high operating cost (3) short mean time before failure (4) long mean time to repair (5) inadequate accuracy and repeatability (6) inadequate confidence that a useful sample will result each time a sample is prepared (due to cracking of the bead, sticking of the bead, the bead being too thin on one edge or too thick on the other edge, or the bead not completely filling the bottom of the casting dish).

One related prior patent is Canadian Pat. No. 1,011,556, issued June 7, 1977 to Fernand Claisse and entitled "Fusion And Casting Machine". The machine disclosed in this prior patent requires frequent adjustment to provide good quality beads. It is fairly complex with many moving parts, and therefore tends to fail too frequently in our experience. The time taken to make repairs is often excessive.

Another patent related to this subject matter is U.S. Pat. No. 4,138,209, issued Feb. 6, 1979, to Warner Bahr, and entitled "Apparatus For Automatically Melting And Casting Fusible Material". In this patent, the mechanism does not provide a motion which would ensure that the particles on the sidewalls of the crucible are "washed" into the melt. If there are undissolved particles on the sidewalls, and some of these particles are washed into the casting dish along with the melt, then one of two unsatisfactory conditions will arise:

(1) the bead will crack because of the discontinuity of the undissolved particle, or if it does dissolve, (2) the bead will not crack, but there will be a locally high concentration of certain elements in the bead.

SUMMARY OF THIS INVENTION

The present invention overcomes the disadvantages of the prior art by utilizing a novel motion for agitating the melt in the crucible. This motion is easily adapted to a linear array of crucibles, burners, and casting dishes (or beakers containing aqueous acid). The main feature of the motion is that the melt (the molten globule of sample dissolved in flux) is encouraged to wash down the crucible walls and to continually roll into areas of the crucible which are preheated by the burner flame. These higher temperature walls then come into contact with the slightly lower temperature melt. These temperature and viscosity gradients within the rolling melt are essential to rapid dissolution (fluxing) and homogenization of the melt.

The preferred embodiment provides a means for moving the crucible with two substantially simple harmonic motions which are 90°, or nearly 90°, out of phase with each other and are of predetermined amplitude. These motions when applied to the crucible through a mechanism cause a motion of the crucible such that the central axis of the crucible sweeps through a substantially conical surface. The apex of this imaginary surface is preferably located substantially on the central axis of the crucible and is spaced from the bottom of the crucible by a distance substantially equal to or less than the crucible height. More preferably, the apex of the conical surface is located at a point approximately corresponding to the lower third of the crucible height on the central axis. This causes the melt to roll around the crucible during agitation, making contact with the sidewall to a degree determined by the angle of tilt, the volume of the melt, and the size and shape of the crucible.

The speed of the motion is selected so that the viscous molten globule will follow the crucible tilt, the globule making one circuit around the crucible for each complete cycle of the crucible motion.

A heating means is provided for each crucible, preferably by the use of a gas burner located below the crucible. Since the motion of the crucible does not cause large excursions of the crucible, the burner may be stationary during agitation. A casting dish is positioned adjacent to each crucible in such a way that preheating of the casting dish is accomplished by the crucible burner, obviating the need for an additional separate warming burner. A means is provided, on completion of the fusion cycle, to automatically cast the melt into the stationary casting dish, or alternatively into a beaker of aqueous acid solution.

As the casting dish is stationary, no difficulties are encountered in maintaining the casting dish in a level position. Hence the beads are of uniform thickness from edge to edge.

A means is provided for controlled cooling of the casting dish and crucible by shutting off the gas burner and introducing cool air through it, which then impinges on the casting dish containing the solidified bead.

The control and cycling of the various functions in appropriate sequence can be handled by a microcomputer. This microcomputer will allow selection of the optimum time cycle parameters within predetermined limits. The equipment can be constructed to be fully automatic, requiring the operator only to initially charge the crucibles with the appropriate materials, initiate the cycle, and on completion remove the cast bead from the casting dish, or alternatively the beaker of aqueous acid solution containing the leached products of the fused sample.

This invention provides a method of fluxing an oxide sample, comprising several steps. The first step is to place the sample in a crucible having a central axis and a bottom. Then, the crucible is heated, thus heating the oxide sample. A motion is applied to the crucible whereby the central axis thereof moves to describe a substantially conical surface having an apex located substantially on the central axis and spaced from the bottom of the crucible by a distance substantially equal to or less than the crucible height. During this motion, the crucible is restrained against rotation about its own axis.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
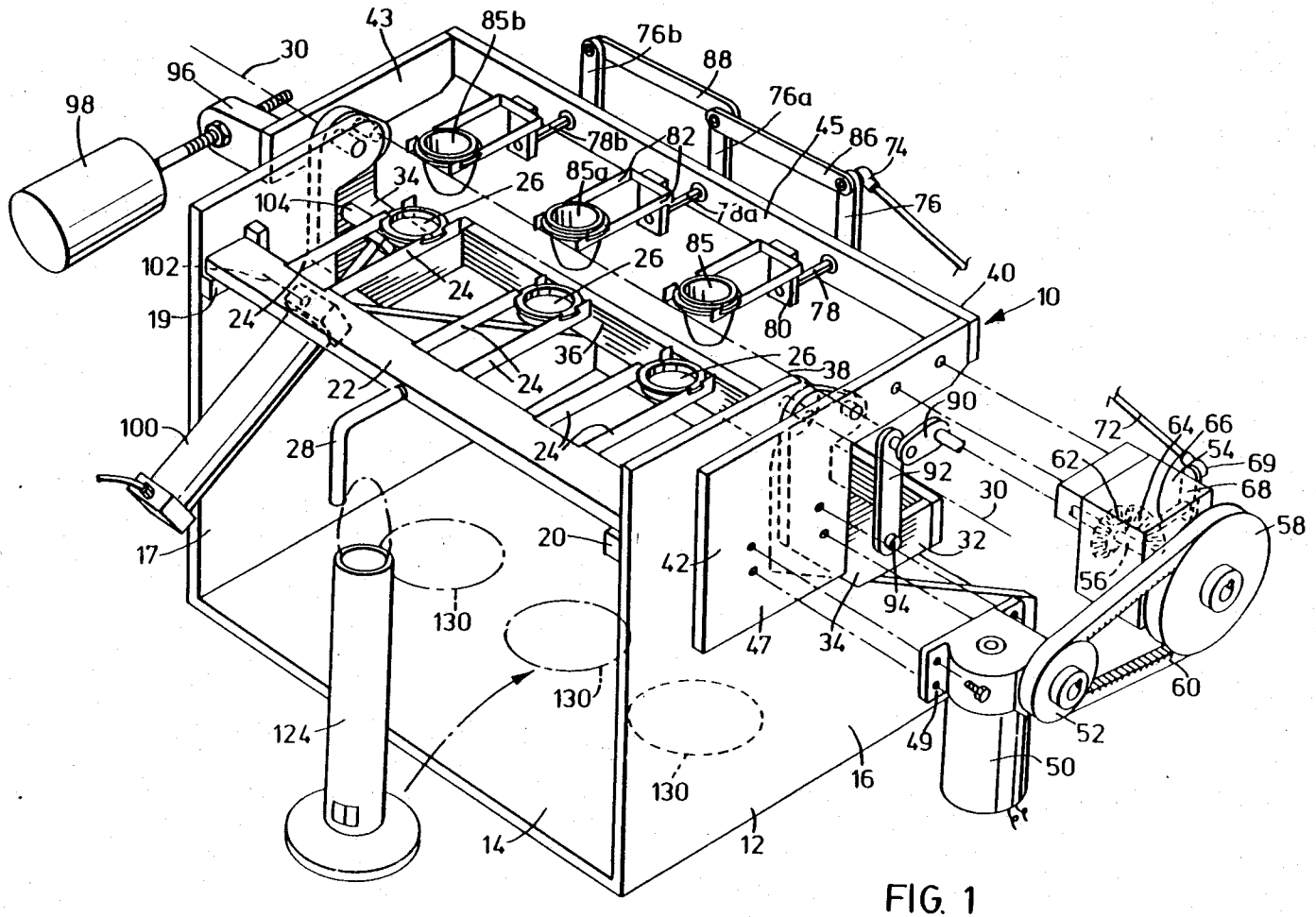
FIG. 1 is a partly exploded perspective view of an apparatus for carrying out this invention.

Attention is first directed to FIG. 1, which shows an apparatus for fluxing and casting samples at 10, this apparatus including a frame 12 comprising a base panel 14 and two sidewalls 16 and 17, the latter being vertical and spaced apart at either edge of the base panel 14. Mounted on the inside surfaces of the sidewalls 16 and 17 are brackets 19 and 20, which support the ends of a horizontal member 22 from which horizontally extend three pairs of arms 24. At the further or rightward ends of the pairs of arms 24, three casting dishes 26 are removably suspended. Leftwardly and centrally projecting from the horizontal member 22 is a handle member 28 which can be grasped in order to lift the entire member and the casting dishes out of the frame 12.

Pivotally mounted with respect to the frame 12 about a horizontal axis identified at 30 in FIG. 1 is a first sub-frame 32 which includes two side arms 34, and an elongated horizontal member 36. The horizontal member 36 spaces apart the side arms 34 and rigidifies the first sub-frame 32.

Pivotally mounted with respect to the first sub-frame 32 about a horizontal axis identified by the numeral 38 in FIG. 1 is a second sub-frame 40 which consists of two side members 42 and 43, joined together and rigidified by a horizontal member 45. The side member 43 is simply an elongated rectangular member, whereas the side member 42 includes a larger rectangular portion 47 having the purpose of mounting a bracket 49 which supports an electric motor 50. Integral with the bracket 49 is a worm-gear reducing mechanism whereby the electric motor 50 can rotate, at a slower speed, a pulley 52.

Also mounted on the side member 42 is a gearing box 54 which supports a shaft 56 on which is mounted a second pulley 58 larger than the first-mentioned pulley 52. A toothed belt 60 is entrained around the pulleys 52 and 58, whereby rotation of the pulley 52 in turn rotates the pulley 58 at a slower speed. Within the gearing box 54 is a first bevel gear 62 securely mounted on the shaft 56, and engaging a second bevel gear 64 which in turn rotates a shaft 66 which projects outwardly through the far wall of the gearing box 54 as pictured in FIG. 1. Fixed to the shaft 66 is an eccentric crank 68 to the end of which is pivotally connected an end 69 of a connecting link 72, the other end 74 of which is pivotally connected to the upper end of an arm 76. The lower end of the arm 76 is securely attached to an end of a shaft 78 which is supported for rotation along an axis substantially at right angles to the horizontal member 45. In the condition in which the apparatus is illustrated in FIG. 1, the shaft 78 is substantially horizontal. The nearer end of the shaft 78 is connected to an upstanding member 80 which at its upper end supports holder arms 82 which in turn rigidly support a crucible 85 which is radially symmetrical about a central axis and is shaped as a cup having sidewalls and a bottom. The sidewalls generally converge downwardly to meet the bottom.

The eccentric crank 68 is shorter than the arm 76, which means that one complete revolution of the eccentric crank 68 will cause merely a rocking motion of the arm 76, and thus of the shaft 78 and crucible 85. As the eccentric crank 68 rotates uniformly, the arm 76 and crucible 85 will undergo substantially harmonic rocking motion in a vertical plane perpendicular to the shaft 78.

Two further arms **76*a* and 76*b* are connected in tandem with the arm 76 through a parallelogram linkage which includes links 86 and 88, whereby all of the arms 76, 76*a* and 76*b* remain parallel to each other during the rocking motion induced by rotation of the eccentric crank 68. To each of the arms 76*a* and 76*b* is attached a respective shaft 78*a*, 78*b*, which, in a manner similar to that shown for the shaft 78, eventually supports a crucible 85*a*, 85*b***.

It will be noted that the horizontal axis 38 about which the two sub-frames 32 and 40 are pivotally mounted with respect to each other passes centrally through the crucibles 85, **85*a* and 85*b*** at a point located in the lower half of each crucible. Preferably, this point is about one-third of the distance from the bottom toward the top of each crucible and intersects the crucible axis.

A hypothetical extension of the axis of the shaft 78 also passes through its respective crucible 85, and preferably intersects both the crucible axis and the horizontal axis 38.

It will now be appreciated that, by providing a mechanism by which the second sub-frame 40 rocks about the horizontal axis 38 with respect to the first sub-frame 32, the crucibles 85, **85*a* and 85*b* can also be given a rocking motion in a vertical plane containing their respective shafts, i.e. perpendicular to the vertical plane of rocking motion caused by the oscillation of the shafts 78, 78*a* and 78*b***.

Such a mechanism is provided, as seen at the right in FIG. 1, through the agency of an eccentric crank 90 connected to the shaft 56, the eccentric crank 90 being in turn connected to the upper end of a link 92 of which the lower end is connected at 94 to the first sub-frame 32. It will thus be appreciated that rotation of the eccentric crank 90 about the axis of the shaft 56, while the lower end of the link 92 is pivoted to the first sub-frame 32, will cause an upward and downward oscillating motion of the position of the shaft 56, and since the latter is fixed with respect to the second sub-frame 40, this sub-frame 40 will likewise undergo a rocking motion about the axis 38.

By setting the positions of the eccentric cranks 68 and 90 to be approximately 90° out of phase, it will be apparent that the crucibles 85, 85*a* and 85*b* can be given a cyclical motion in which the central axis of each crucible describes a substantially conical surface having its apex located at the convergence of the crucible axis with the horizontal axis 38 and the extended axis of the corresponding shaft.

A bracket 96 connected to the side member 43 supports an adjustable counterweight 98, so that the second sub-frame 40 will be substantially balanced about the axis 38.

Pivotally supported from the sidewall 17 is a cylinder and piston assembly 100, the pivot axis being shown at 102 in FIG. 1. The outward end of the piston of the assembly 100 is pivotally mounted to a shaft 104 which is supported from the side arm 34 of the first sub-frame 32. It will thus be appreciated that, upon extension of the piston of the assembly 100, the first sub-frame 32, and with it the second sub-frame 40 and the crucibles 85, are pivoted in the counter-clockwise sense (assuming the assembly is viewed from the right in FIG. 1) about the pivot axis 30.

Figure 5:
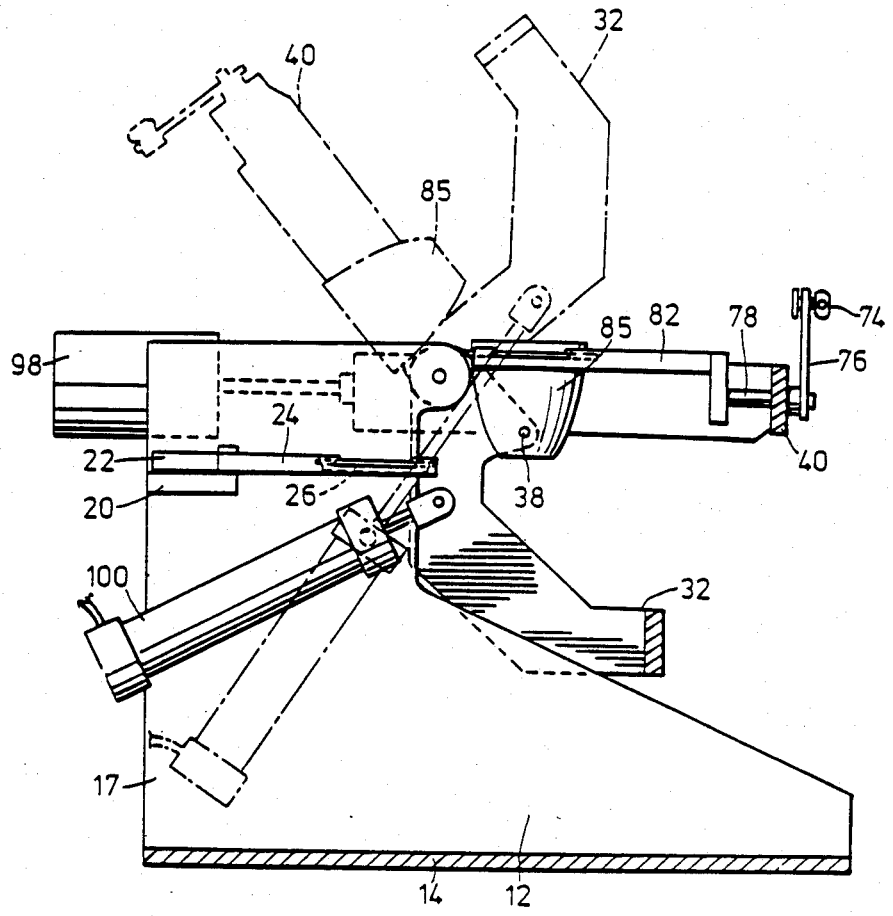
FIG. 5 is a sectional view taken at the line 5—5 in FIG. 1, showing how the mechanism achieves the dumping movement.

Attention is directed to FIG. 5, which shows in solid lines the initial position of the sub-frames 32 and 40, and the crucible 85, and which shows the final or dumping position of the crucible in broken lines. It will be noted in FIG. 5 that in the dumping position shown in broken lines, the casting dish 26 is directly below the partly inverted crucible 85.

Figure 2:
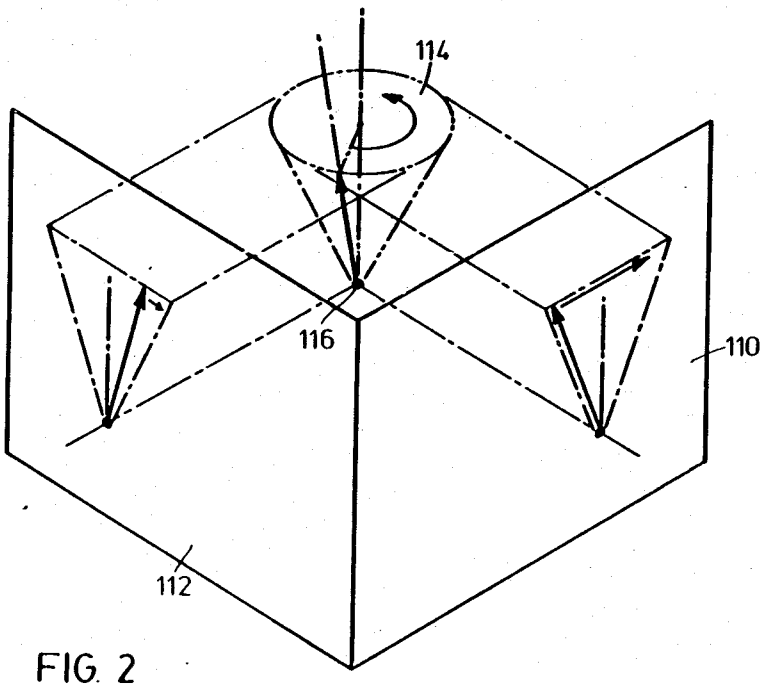
FIG. 2 is a schematic view illustrating the combination of motions which result in the movement of the crucible.

Attention is now directed to FIG. 2, which shows schematically how two rocking motions in vertical planes 110 and 112 which are perpendicular to each other can, provided the phasing is correct, result in a conical motion 114 with the apex located at 116. This is essentially what takes place as the combined rocking motion of the shaft 78 and the second sub-frame 40 cause a conical movement of the axis of the crucible 85, while the crucible itself is restrained against rotation about its own axis, due to being held securely in the arms 82.

Figure 3:
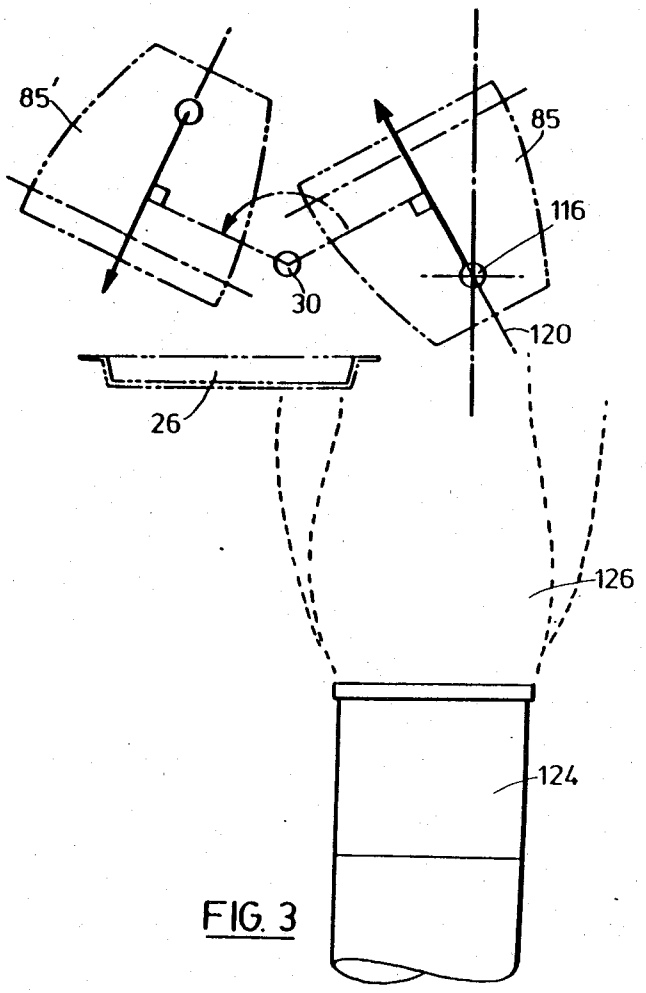
FIG. 3 is a schematic view showing the dumping motion by which the contents of the crucible are poured into a casting dish.

Attention is now directed to FIG. 3, which illustrates schematically the dumping action for the crucible 85, in which the fluxed oxide sample is poured into the casting dish 26. In order to adjust the position of the crucible for pouring, the gyrating motion of the crucible is halted with the axis 120 of the crucible 85 inclined toward the casting dish 26, i.e. aligned in a vertical plane which also contains the axis of the shaft 78 (see FIG. 1). In effect, this provides a portion of the eventual tilt angle prior to tilting the sub-frames 32 and 40. Then, with the crucible 85 halted in this position, the cylinder and piston assembly 100 is actuated to rotate the sub-frames 32 and 40 in the counter-clockwise direction as seen from the right in FIG. 1, until the crucible 85 comes to the position shown at the left and identified as 85' in FIG. 3. In this position, the contents of the crucible pour out into the casting dish 26.

It will be noted in FIG. 3 that a burner 124 is provided, substantially aligned under the apex 116 of the conical movement of the crucible 85. However, the flame 126 from the burner 124 contacts an edge portion of the casting dish 26, and thus maintains a constant heat input to the casting dish to keep it at a desired temperature.

It should be noted that the drawing in FIG. 5 illustrates the crucible 85 rotating through the same angle as is shown in FIG. 3, but starting from a vertical orientation. (Such an orientation is discussed subsequently.)

The angle through which the crucible 85 rotates during the pour in FIG. 3 is approximately 126°, although it will be understood that greater or lesser angles could also be utilized so long as an efficient pouring could take place.

In FIG. 1, the burner 124 is illustrated in a removed position outside of the frame 12. It will be understood that three such burners would be provided, one for each crucible 85, 85*a* and 85*b*, and that these would be positioned approximately where shown by the broken-line circles 130 in FIG. 1. In each case, the envelope of the flame would touch a portion of the respective casting dish 26.

Figure 4:
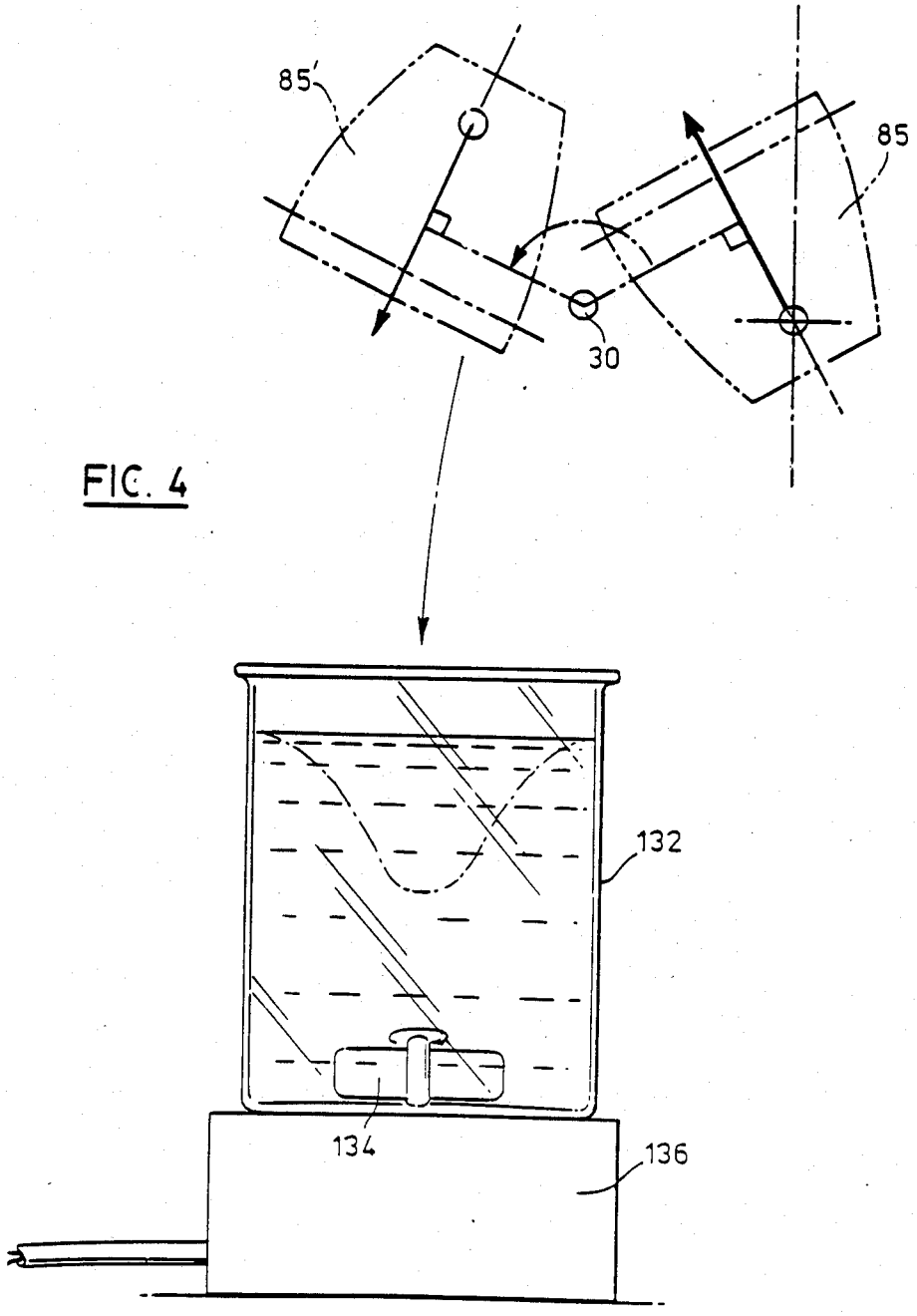
FIG. 4 is a schematic view showing the motion by which the contents of the crucible are dumped into a beaker of aqueous acid solution.

Attention is now directed to FIG. 4, which illustrates the crucible 85 again rotating to the pouring position illustrated at 85', the rotation being through the same angle as is shown in FIG. 3. In the case of FIG. 4, however, the fluxed oxide sample is dumped into a beaker 132 of aqueous acid solution according to the known technique. Within the beaker 132 is a magnetic stirring bar 134, and the beaker sits atop a magnetic stirring device 136.

It is preferable that the crucibles 85, 85*a* and 85*b* be made of platinum-gold alloy, since this material is non-wetting, although other alloys and materials may also be employed. The support arms 82 also extend into the heated gas from the burners 124, and should be of heat resistant material such as Nichrome V (80% nickel, 10% chromium).

Typically, the oscillation or rocking angle for the shafts 78, 78*a* and 78*b* would lie between 20° and 45°. The same preferred angular limits would apply to the rocking motion of the second sub-frame 40 with respect to the first sub-frame 32 about the axis 38.

The motor 50 is preferably a variable speed motor, permitting the frequency of rotation of the axes of the crucibles to be adjusted by the operator.

It is important to note that the horizontal axis 38 and the axis of the individual shafts 78, 78*a* and 78*b* need not necessarily exactly intersect the axes of the respective crucibles 85, 85*a* and 85*b*. Nor is it essential for the central axis of each crucible to describe the surface of a perfect circular cone. Some departure from a circular conical surface would work as well, to all intents and purposes. The main object is to cause the molten globule of flux and sample to roll about the bottom of the crucible in a manner which efficiently mixes the sample and flux. As previously mentioned, a favourable motion is obtained when the molten globule constantly rolls down the tilted bottom of the crucible and at the same time is deflected off the side of the crucible. In any specific application, the important considerations are (1) the geometry of the crucible, (2) the volume of the contents, (3) the location of the various axes, (4) the amplitude of the oscillatory motions about these axes, and (5) the angular velocity of the drives. In a specific tested embodiment, the following operating parameters have been found to be suitable:

(a) The rocking angle for the shafts 78, 78*a* and 78*b* was 33°.

(b) The rocking angle of the second sub-frame 40 with respect to the first sub-frame 32 about the horizontal axis 38 was 39°.

(c) The frequency of rotation for each crucible was 30 rpm.

(d) The sample weight was 6% of the flux weight, and the latter was between 8 and 9 grams (anhydrous sodium tetraborate).

Although a gas burner 124 has been illustrated in the drawings and described above, other heating means may also be utilized. The main consideration is that the heating method would permit melting of the flux, although it is also important to ensure that the flux and the sample are heated in an oxygen rich atmosphere and that the temperature does not reach the point where the flux or the sample is lost by evaporation. It should be stated, however, that small controlled losses through evaporation may be desirable if the speed of homogenization is an important trade-off to evaporative loss.

Refractory lined muffle furnaces are considered undesirable in cases where the flux evaporates and is of a kind which attacks the refractory so that spalling occurs. Induction furnaces may be utilized but are a very expensive way of heating the crucible and the casting dish, especially if a multiple crucible arrangement is to be utilized. However, the present invention does not rule out the use of a work coil encircling the crucible and moving with the crucible.

The preferred heating method is to use a Meker type burner with a needle valve orifice and an anti-flashback grid chosen for use with propane gas. For example the Fisher Burner Catalogue No. 3-907P has been found to be suitable. In this burner, the venturi tube thoroughly mixes air and propane in the proper ratio for complete combustion just above the grid. As previously explained, the crucible moves within the volume of the flame during oscillation, and the casting dish is warmed by positioning the edge of the dish in the flame. A dull red heat at the edge of the casting dish will indicate adequate preheating of the casting dish. It is contemplated to employ a photo-electric position sensor to ensure that the oscillating assembly has returned the crucible to the "toward" position illustrated in FIG. 3, this being also one of the two central positions of the left/right motion. The crucible would be left in the casting position long enough to ensure that all of the viscous contents of the crucible will have sufficient time to completely pour out of it. The cylinder and piston assembly 100 is then actuated to withdraw the piston, thus returning the crucible to its initial position shown at the right in FIG. 3.

After the crucible has returned to its initial position, the flame from the heater 124 is extinguished. Then, following a suitable cooling period of about 10 seconds, a flow of air is delivered through the burner 124 to aid in the cooling of the crucible and the casting dish. When this cooling period is completed, an audible alarm would alert the operator to remove the sample beads.

When preparing an aqueous acid solution (FIG. 4), the molten contents of the crucible are poured directly into the beaker 132 as explained above. Depending on the size of the beaker and of the magnetic stirrer (if one is used), it may be necessary to increase the distance between the axes 30 and 38 (FIG. 1), thus avoiding interference between the burners and the beakers. The apparatus could be provided with removable pins to establish the various axes, so that it could quickly be adapted for pouring into either a casting dish or a beaker.

It would also be possible to make the axes 30 and 38 coincident, although this would require a mechanism to move the burner out of the way as the casting dish or beaker were moved into a position beneath the crucible (i.e. the position previously occupied by the burner).

While a specific and simple means of achieving the desired motion of the crucible has been described above, other methods of achieving this same motion may be devised. For example, the simple harmonic motion may be transmitted from a rotating drive directly by a belt, chains, cable, fluid or other mechanical means. This may be achieved by a single motor drive delivering dual outputs with the required angular phase shift, or by dual motor drives phase-locked to the required angular phase shift.

While the specific embodiment described above has a constant phase shift of 90°, it may be desirable during loading of the crucible to bring it back to a truly vertical position. This is possible by negating the phase shift. There are several means of accomplishing this with either of the drive approaches. For example, by driving one of the two output shafts through a coupling with 90° backlash, the desired negation is accomplished by reversing the direction of rotation.

The apparatus and its controller are easily adjusted to suit any specific application, within the limits of the design parameters. The linear arrangement of stations allows the number of samples which can be prepared at one time to be readily increased beyond three. Only where a more compact unit size is needed would the capacity be reduced to two or even one. The specific arrangement of the apparatus is somewhat flexible at the time of the initial set-up, and the timing of each event in the cycle of operation is user-definable and under the repeatable control of a microcomputer.

It will be understood that the mechanism described above and shown in the accompanying drawings does not give rise to large excursions of the crucible within the burner flame, or in space in general. It therefore becomes convenient, if desired, to add one or more of the enhancements listed below:

1. An oxygen lance directed into the crucible to aid oxidation.
2. A reflective cover to help retain heat in the crucible.
3. A radiation temperature sensor sighted on the melt.
4. A long-focus camera and flash illuminator for studying the progress of fluxing of the sample.
5. A compact, tightly coupled hot gas exhaust system.

While one embodiment of this invention has been illustrated in the accompanying drawings and described hereinabove, it will be evident to those skilled in the art that changes and modifications may be made therein, without departing from the essence of this invention as set forth in the appended claims.

What we claim is:

1. A method of fluxing an oxide sample, comprising the steps:

placing the sample in a crucible having a central axis and a bottom, heating the crucible and thus the oxide sample, and applying to the crucible a motion whereby the central axis moves to describe a substantially conical surface having an apex located substantially on the central axis and spaced from the bottom of the crucible by a distance substantially equal to or less than the crucible height, and restraining the crucible against rotation about its own axis.

2. The method claimed in claim 1, in which the crucible is heated by heating means stationary with respect to a frame, the crucible motion being a combination of a first rocking movement in a first substantially vertical plane and a second rocking movement in a second substantially vertical plane perpendicular to the first vertical plane, the movements having the same frequency but being phased so as to result in said motion.

3. The method claimed in claim 2, in which each movement is brought about through the action of a separate eccentric crank acting on one end of a separate connecting link.

4. The method claimed in claim 2, including the further steps of arresting said motion of the crucible, then pouring the contents thereof into a casting dish which is stationary with respect to the frame and is heated by the heating means.

5. The method claimed in claim 2, including the further steps of arresting said motion of the crucible, then pouring the contents thereof into a beaker containing an aqueous acid solution.

* * * * *